US010141150B2

(12) United States Patent
Aberin et al.

(10) Patent No.: US 10,141,150 B2
(45) Date of Patent: Nov. 27, 2018

(54) HIGH CURRENT ONE-PIECE FUSE ELEMENT AND SPLIT BODY

(71) Applicant: LITTELFUSE, INC., Chicago, IL (US)

(72) Inventors: Edwin C. Aberin, Batangas (PH); Redante R. Abad, Muntinlupa (PH); Chito D. Sumalinog, Batangas (PH)

(73) Assignee: LITTELFUSE, INC., Chicago, IL (US)

( * ) Notice: Subject to any disclaimer, the term of this patent is extended or adjusted under 35 U.S.C. 154(b) by 0 days.

(21) Appl. No.: 15/045,893

(22) Filed: Feb. 17, 2016

(65) Prior Publication Data

US 2017/0236675 A1 Aug. 17, 2017

(51) Int. Cl.

| | |
|---|---|
| ***H01H 85/17*** | (2006.01) |
| ***H01H 69/02*** | (2006.01) |
| ***H01H 85/08*** | (2006.01) |
| ***H01H 85/143*** | (2006.01) |

(52) U.S. Cl.
CPC ..... *H01H 85/17* (2013.01); *H01H 69/02* (2013.01); *H01H 85/08* (2013.01); *H01H 85/143* (2013.01)

(58) Field of Classification Search
CPC .... H01H 85/38; H01H 85/165; H01H 85/143; H01H 85/055; H01H 85/18; H01H 2085/383; H01H 2085/0414; H01H 85/17; H01H 69/02; H01H 85/08
See application file for complete search history.

(56) References Cited

U.S. PATENT DOCUMENTS 4,308,515 A * 12/1981 Rooney ..... H01H 85/055 337/162
4,563,666 A 1/1986 Borzoni
4,608,548 A * 8/1986 Borzoni ..... H01H 85/0417 337/186
4,894,633 A * 1/1990 Holtfreter ..... H01H 85/0411 337/201
5,015,176 A 5/1991 Gurevich
5,130,688 A * 7/1992 Van Rietschoten .... H01H 85/38 337/231
5,929,740 A * 7/1999 Oh ..... H01H 85/0417 337/180
6,376,774 B1 * 4/2002 Oh ..... H01H 85/10 174/92
2003/0142453 A1 * 7/2003 Parker ..... H01H 85/046 361/104

(Continued)

FOREIGN PATENT DOCUMENTS

| | | |
|---|---|---|
| DE | 2931832 A1 | 2/1980 |
| GB | 2381651 B | 1/2004 |
| WO | 2015030023 A1 | 3/2015 |

OTHER PUBLICATIONS

ISR and Written Opinion dated Jun. 9, 2017 in corresponding PCT/US2017/017163.

*Primary Examiner* — Jayprakash N Gandhi
*Assistant Examiner* — Stephen Sul

(57) ABSTRACT

A compact, high breaking capacity fuse that includes a top and bottom insulative layer and a single piece fusible element disposed between the top and bottom insulative layer. The top and bottom insulative layers include cavities that are aligned at assembly to form a chamber in which a fusible element portion of the single piece fusible element is disposed. The single piece fusible element additionally includes terminal portions that extend along outer surfaces of the top and bottom insulative layers.

14 Claims, 6 Drawing Sheets

(56) References Cited

U.S. PATENT DOCUMENTS

| | | | | |
|---|---|---|---|---|
| 2012/0133478 | A1 | 5/2012 | Chiu | |
| 2013/0106565 | A1* | 5/2013 | Arce | H01H 85/165 337/205 |
| 2014/0133059 | A1* | 5/2014 | Wang | H01H 85/0411 361/103 |
| 2014/0266565 | A1* | 9/2014 | Enriquez | H01H 85/08 337/297 |

* cited by examiner

HIGH CURRENT ONE-PIECE FUSE ELEMENT AND SPLIT BODY

FIELD OF THE DISCLOSURE

The disclosure relates generally to the field of circuit protection devices and more particularly to a compact, low cost, high breaking capacity fuse.

BACKGROUND OF THE DISCLOSURE

In many circuit protection applications, it is desirable to employ fuses that are compact and that have high "breaking capacities." Breaking capacity (also commonly referred to as "interrupting capacity") is the current that a fuse is able to interrupt without being destroyed or causing an electric arc of unacceptable duration. Certain fuses currently available exhibit high breaking capacities and are suitable for compact applications. However, such fuses are often relatively expensive and can be prone to failure or exhibit reliability issues due to the connection between the fuse element and terminals. It is therefore desirable to provide a low cost, reliable, high breaking capacity fuse that is suitable for compact circuit protection applications.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

In accordance with the present disclosure, a compact, high breaking capacity fuse is disclosed. An exemplary high breaking capacity fuse may include a first outer insulative layer, the first outer insulative layer comprising a first cavity. Additionally, the fuse may include a second outer insulative layer coupled to the first outer insulative layer where the second outer insulative layer comprises a second cavity to align with the first cavity defining a chamber. Additionally, the fuse may include a single piece fusible element disposed between the first outer insulative layer and the second outer insulative layer. The single piece fusible element comprising a first terminal portion, a second terminal portion, and a fusible element portion arranged between the first and second terminal portions, wherein the fusible element portion is disposed at least partially within the chamber. The first terminal portion extends along at least one outer surface of the second outer insulative layer and the second terminal portion extends along at least one outer surface of the second outer insulative layer.

DETAILED DESCRIPTION

Figure 1:
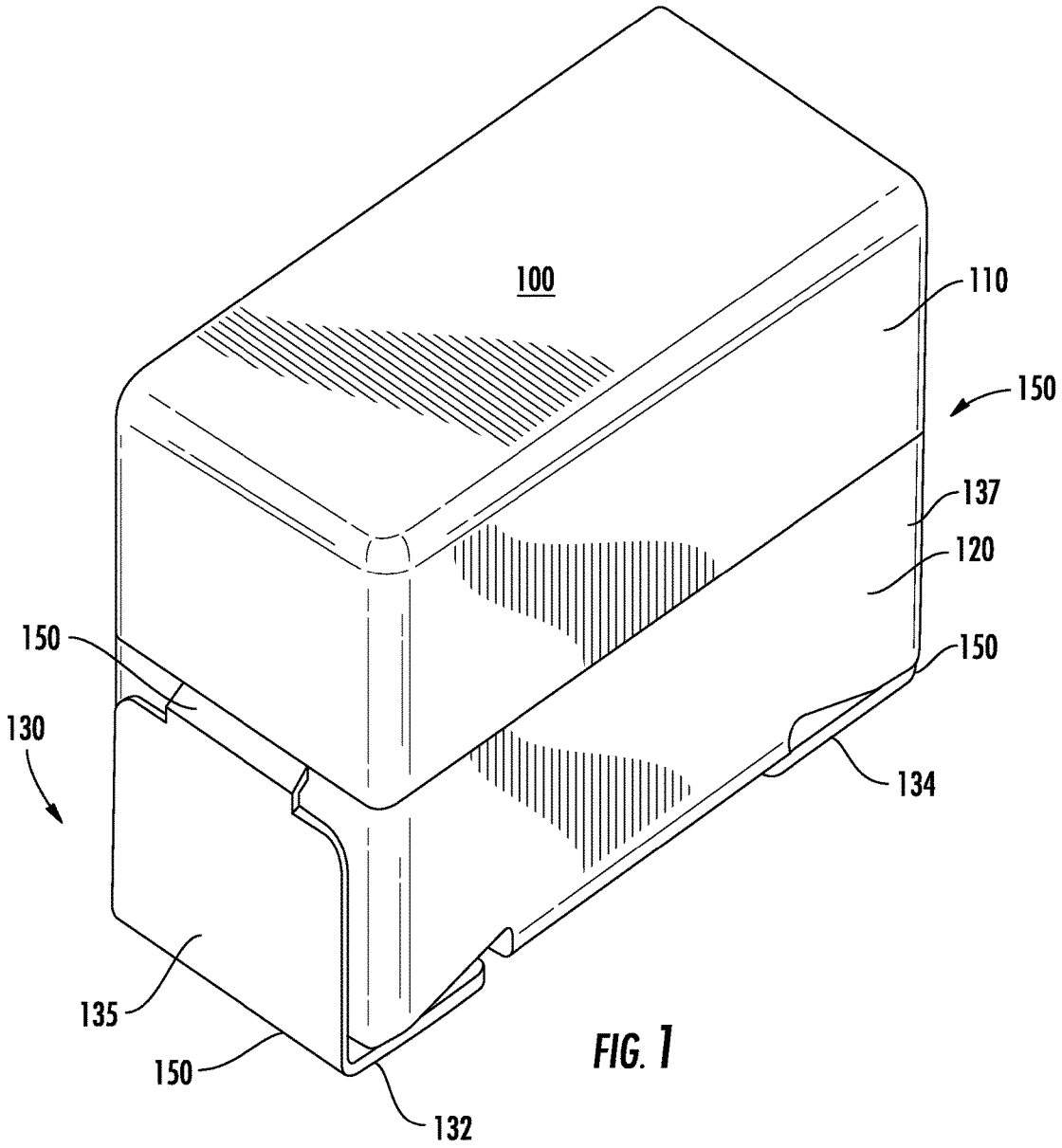
FIG. 1 is a perspective view of a high breaking capacity fuse in assembled configuration.

The present invention will now be described more fully hereinafter with reference to the accompanying drawings, in which preferred embodiments of the invention are shown. This invention, however, may be embodied in many different forms and should not be construed as being limited to the embodiments set forth herein. Rather, these embodiments are provided so that this disclosure will be thorough and complete, and will fully convey the scope of the invention to those skilled in the art. In the drawings, like numbers refer to like elements throughout.

Figure 2:
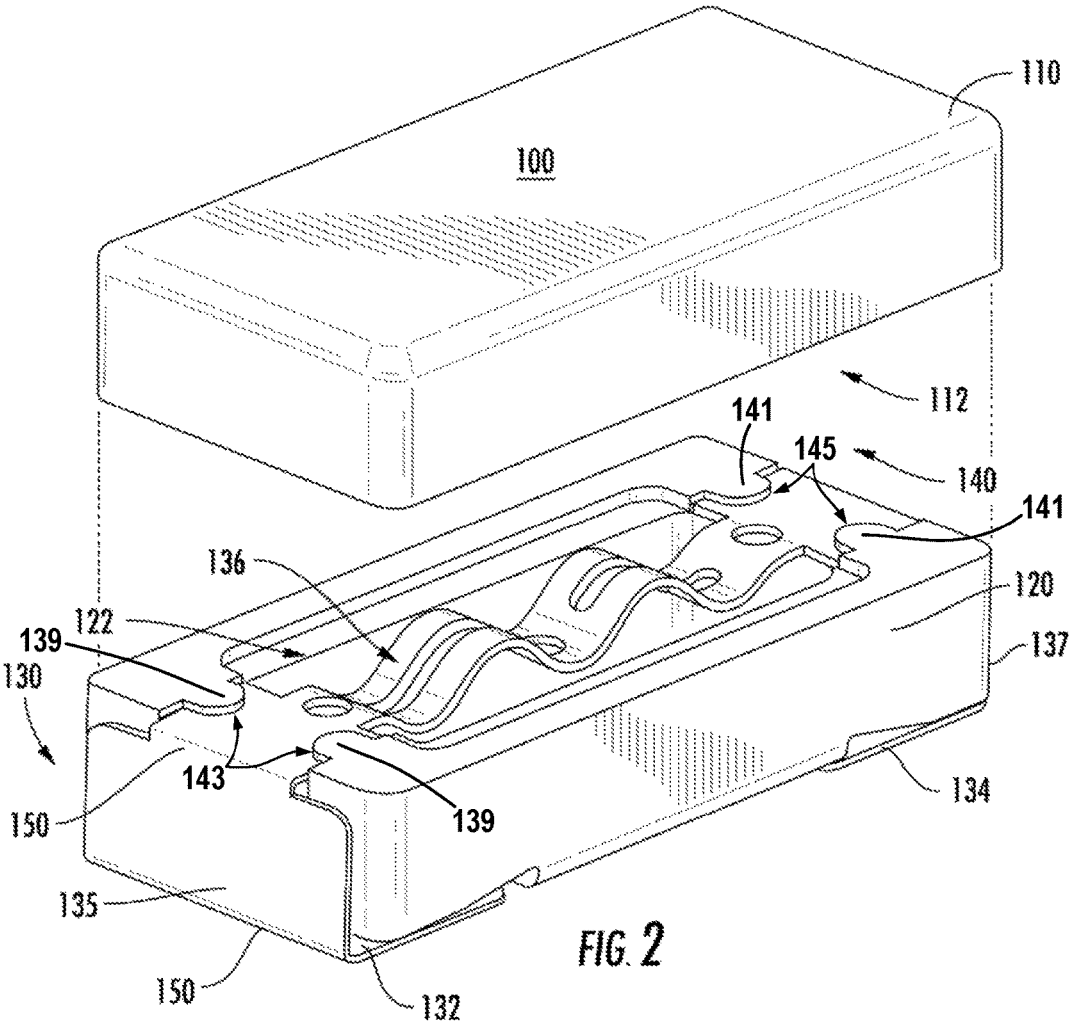
FIG. 2 is a perspective view of the high breaking capacity fuse shown in FIG. 1 in an exploded configuration.

FIGS. 1-2 illustrate a high breaking capacity fuse 100, arranged according to at least one example of the present disclosure. The high breaking capacity fuse 100 (hereinafter referred to as "the fuse 100") is shown in an assembled view in FIG. 1 and in an exploded view in FIG. 2. The fuse 100 may include a first outer insulative layer 110 (sometimes referred to as "the top layer 110" for convenience) and a second outer insulative layer 120 (sometimes referred to as "the bottom layer 120" for convenience). When assembled as shown in FIG. 1, the top and bottom layers 110 and 120 may be joined together to form a fuse package. In some examples, the top and bottom layers 110 and 120 can be joined using an ultrasonic welding process, with epoxy, with a non-conductive adhesive, or with mechanical fasteners. The top and bottom layers 110 and 120 may be substantially rectangular in shape and may be formed of any suitable, electrically insulative material, including, but not limited to, FR-4, glass, plastic, etc.

The fuse 100 additionally includes a single piece fusible element 130 disposed between the top and bottom layers 110 and 120. Portions of the single piece fusible element 130 extend out from the top and bottom layers 110 and 120 and are bent about the top and bottom layers 110 and 120 to form terminal portions. In particular, the single piece fusible element 130 can include first and second terminal portions 132 and 134, a fusible element portion 136, and first and second mid portions 135 and 137. Each of the first and second terminal portions 132, 134 may have respective grooves 139, 141 formed in opposing sides thereof, and the first outer insulative layer 110 may include tongue portions 143, 145 formed in a top edge thereof, the tongue portions 143, 145 disposed within the grooves 139, 141 respectively. In general, the single piece fusible element 130 can be formed from any conductive material. In some examples, the single piece fusible element 130 can be formed from copper, tin, silver, aluminum, some combination of these materials, or an alloy including one or more of these materials. In some examples, the single piece fusible element 130 can be formed from a single piece of conductive material.

The single piece fusible element 130 thereby provides an electrically conductive pathway between the terminal portions 132 and 134. In particular, an electric current pathway is provided between the terminal portions 132 and 134 via the mid portions 135 and 137 and the fusible element portion 136.

The top and bottom layers 110 and 120 each include a cavity. For example, in FIG. 2, the cavity 122 of the bottom layer 120 is depicted. The top layer 110 may also include a cavity 112, which is obscured due to the perspective nature of the depiction in this figure. When the fuse is assembled (e.g., FIG. 1) the cavities 112 and 122 may be aligned to define a chamber 140. The fusible element portion 136 of the single piece fuse element 130 can be disposed in the chamber 140. Accordingly, the fusible element portion 136 may be at least partially surrounded by air.

The fusible element portion 136 of the single piece fusible element 130 is a "weak point" that will predictably separate upon the occurrence of an overcurrent condition in the fuse 100 to interrupt the overcurrent condition and break the electric current pathway between the terminal portions 132 and 134. Since the fusible element portion 136 is surrounded by air and not in contact with, or in proximity to, the insulative material that forms the top and bottom layers 110 and 120, an electric arc that forms as the fusible element 136 separates during an overcurrent condition is deprived of fuel (i.e. surrounding material) that might otherwise sustain the arc. Arc time is thereby reduced, which in-turn increases the breaking capacity of the fuse 100.

In general, the mid portions 135 and 137 of the single piece fusible element 130 are bent out of parallel from the fusible element portion 136 along its longitudinal axis. In particular, the single piece fusible element 130 comprises bends 150 such that portions of the single piece fusible element extend along and/or are positioned proximate to various external surfaces of the top and bottom layers 110 and 120. For example, the single piece fusible element 130 can include bends 150 between the terminal portions 132 and 134 and the mid portions 135 and 137, respectively (e.g., at distal ends of the terminal portions 132 and 134). Additionally, the single piece fusible element 130 can include bends 150 between the mid portions 135 and 137 and the fusible element portion 136. Accordingly, the mid portions 135 and 137 can extend along opposing external side surfaces of the bottom layer 120 while the terminal portions 132 and 134 extend along the external bottom surface of the bottom layer 120. In some examples, the bottom layer 120 may be formed to accommodate the portions of the single piece fusible element 130 bent and extending along the external surfaces. For example, cutouts or depressions may be formed to accommodate the mid portions 135 and 137 and the terminal portions 132 and 134.

Figure 3:
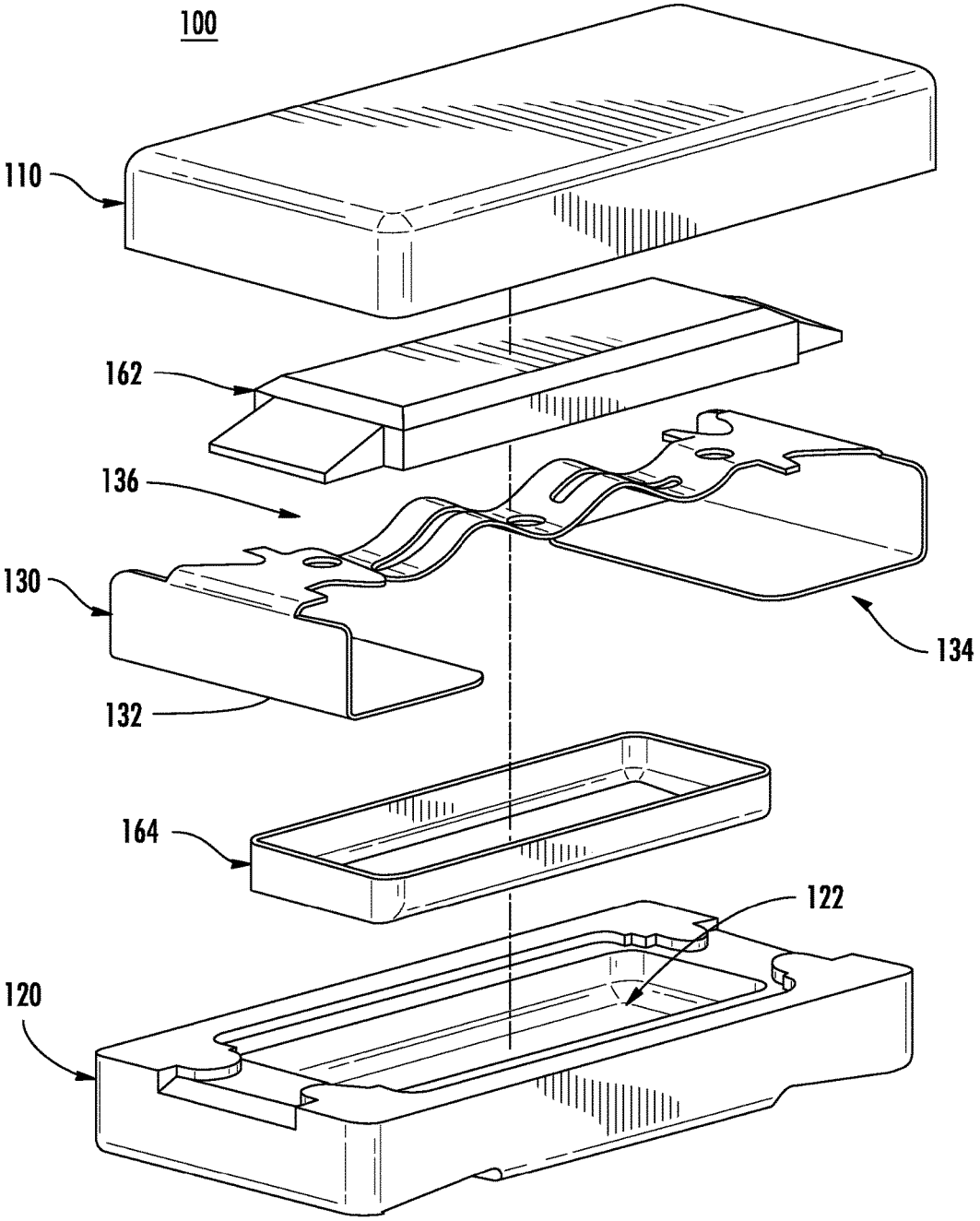
FIG. 3 is a perspective view of a high breaking capacity fuse in an exploded configuration, illustrating a fuse array in accordance with the present disclosure wherein several high breaking capacity fuses are arranged in a contiguous, arrayed configuration.

The terminal portions 132 and 134 and the mid portions 135 and 137 are substantially parallel to an external surface of the bottom layer 120. In some examples, the terminal portions 132 and 134 are substantially parallel to the fusible element portion 136 while the mid portions 135 and 137 are substantially perpendicular to both the terminal portions 132 and 134 and the fusible element portion 136. The fuse 100 can include ceramic portions or a ceramic coating on portions of the top and bottom layers 110 and 120 to increase the breaking capacity of the fuse 100 and protect the fuse body (e.g., top and bottom layers 110 and 120) from rupture or breakage during high current interruption. FIG. 3 depicts the fuse 100, arranged according to at least one example of the present disclosure and including such ceramic elements. It is noted, that this figure depicts the fuse 100 in an exploded view and further includes the element of the fuse 100 described above with respect to FIGS. 1-2.

The fuse 100 may include ceramic inserts 162 and 164 disposed in the chamber 140 and around the fusible element portion 136. These ceramic inserts can be formed to be disposed in and/or or affixed into the cavities 112 and 122. For example, the ceramic insert 162 may be formed to be disposed within the cavity 112. Likewise, the ceramic insert 164 may be formed to be disposed within the cavity 122. As such, when the fuse 100 is assembled, the fusible element portion 136 may be surrounded by air within the chamber 140, while the chamber 140 is defined by the ceramic inserts 162 and 164.

The fuse 100 may include ceramic coating portions 162 and 164, which may be coated onto the inside portions of the top and bottom layers 110 and 120 defining the cavities 112 and 122. As such, when the fuse 100 is assembled, the fusible element portion 136 may be surrounded by air within the chamber 140, while the chamber 140 is defined by the ceramic coated cavities 112 and 122.

Figure 4A:
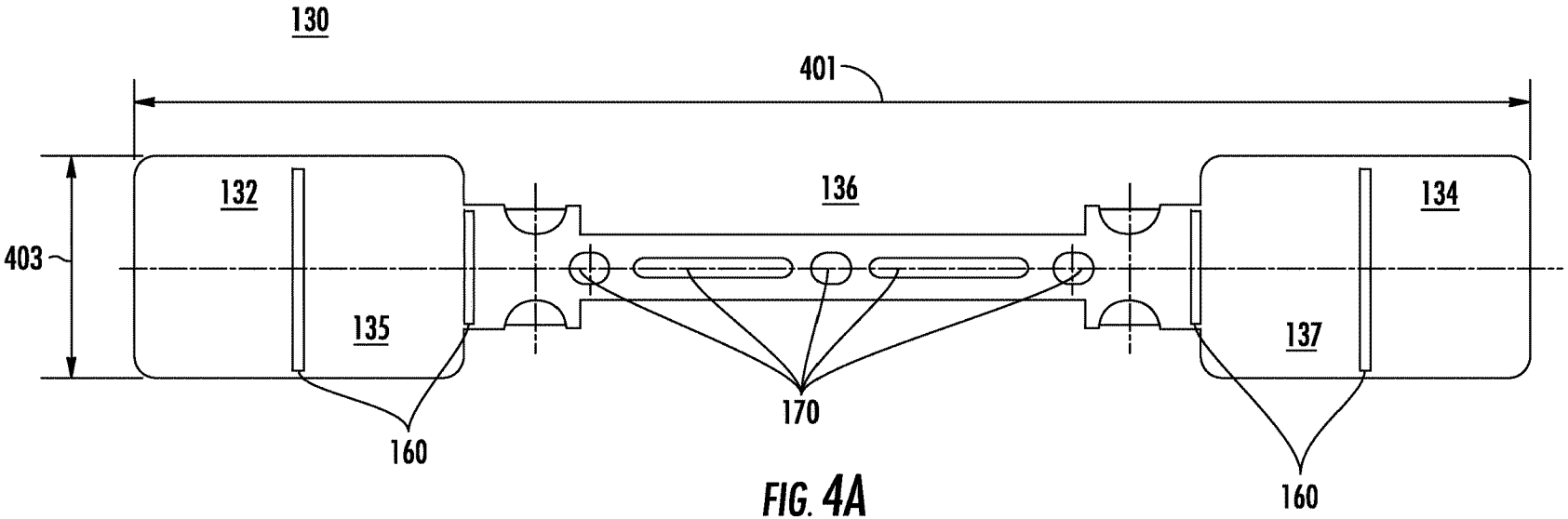
FIG. 4A is a top view a single piece fusible element.
Figure 4B:
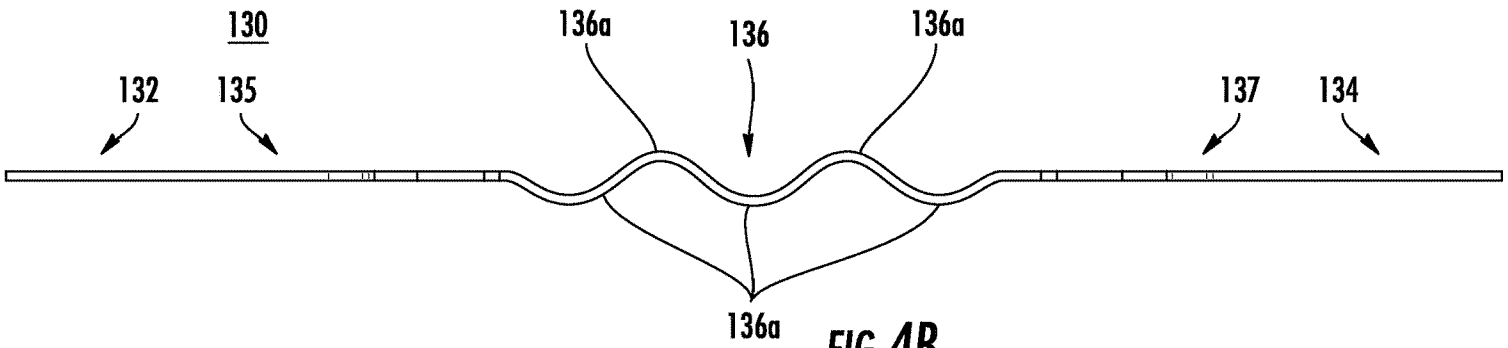
FIG. 4B is a side view of the single piece fusible element shown in FIG. 4A.

As will be appreciated by those of ordinary skill in the art, the size, configuration, and conductive material of the single piece fusible element and particularly the fusible element portion 136 may all contribute to the rating of the fuse 100. For example, the length 401 and/or the width 403 of the single piece fusible element 130 may vary. Additionally, the ratio of the length 401 to the width 403 can vary. Turning to FIGS. 4A-4B, an example of the single piece fusible element 130 is provided. As described in conjunction with FIGS. 1-2, the single piece fusible element 130 includes a fusible element portion 136 and terminal portions 132 and 134. Additionally, mid portions 135 and 137 may be provided between the fusible element portion 136 and the terminal portions 132 and 134.

The single piece fusible element 130 may comprise bending impressions 160 between the terminal portions 132 and 134 and the mid portions 135 and 137 and/or between the mid portions 135 and 137 and the fusible element portion 136. The bending impressions 160 may facilitate bending the portions of the single piece fuse element to extend along outer surfaces of the top and bottom layers. For example, the bending impressions 160 may reduce stress in the single piece fusible element 130 as the mid portions 135 and 137 and the terminal portions 132 and 134 are bent to be perpendicular to the fusible element portion 136. Additionally, the bending impressions 160 may reduce stress in the single piece fusible element 130 as the terminal portions 132 and 134 are bent to be perpendicular to the mid portions 135 and 137 and parallel to the fusible element portion 136. The mid portions (e.g., 135 and 137) and terminal portions (e.g., 132 and 134) may be substantially rectangular in shape. The fusible element portion 136 may have a rectangular section that is narrower than the terminal portions 132 and 134. The fusible element portion 136 may also have one or more cutouts 170 and one or more rolls or waves **136*a* when viewed from side profile as illustrated in FIG. 4**B.

In some examples, the single piece fusible element 130 can be formed by stamping, machining, casting, or the like, a sheet or conductive material to form the profile and shape desired for the single piece fusible element 130. Accordingly, the profile and shape of the fusible element portion as well as bending impressions can be formed in a single process, such as a stamping process.

Figure 5A:
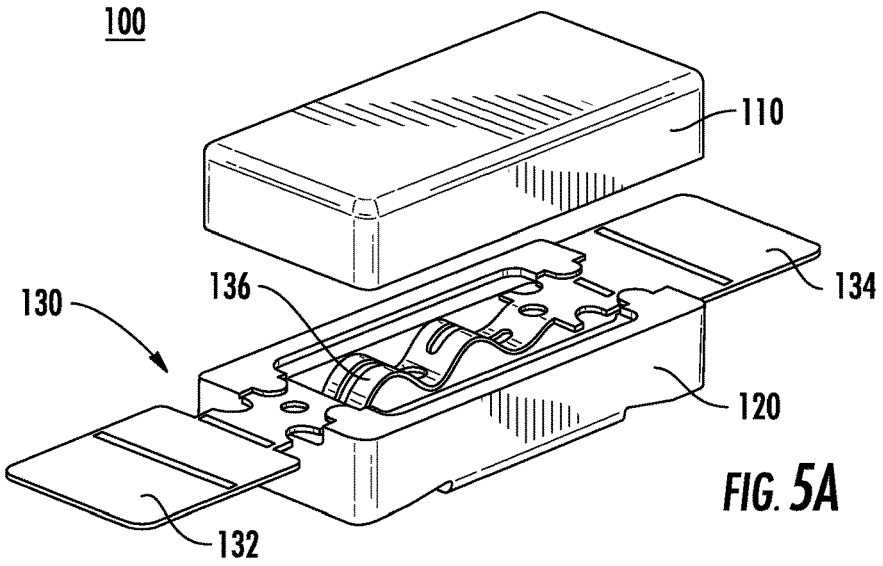
FIGS. 5A-5C are perspective views of a high breaking capacity fuse during stages of assembly.
Figure 5B:
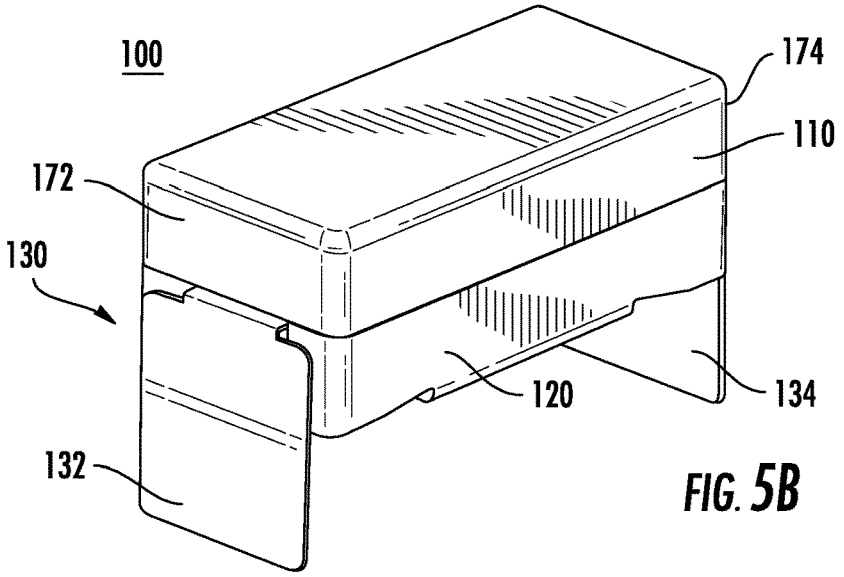
Figure 5C:
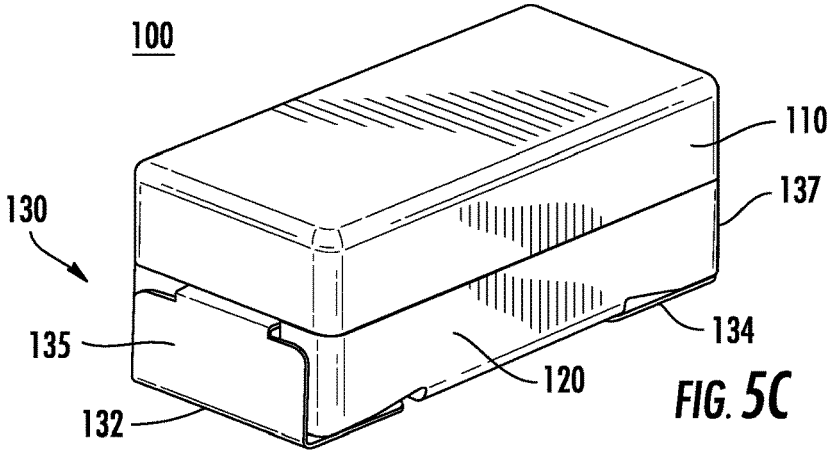
Figure 6:
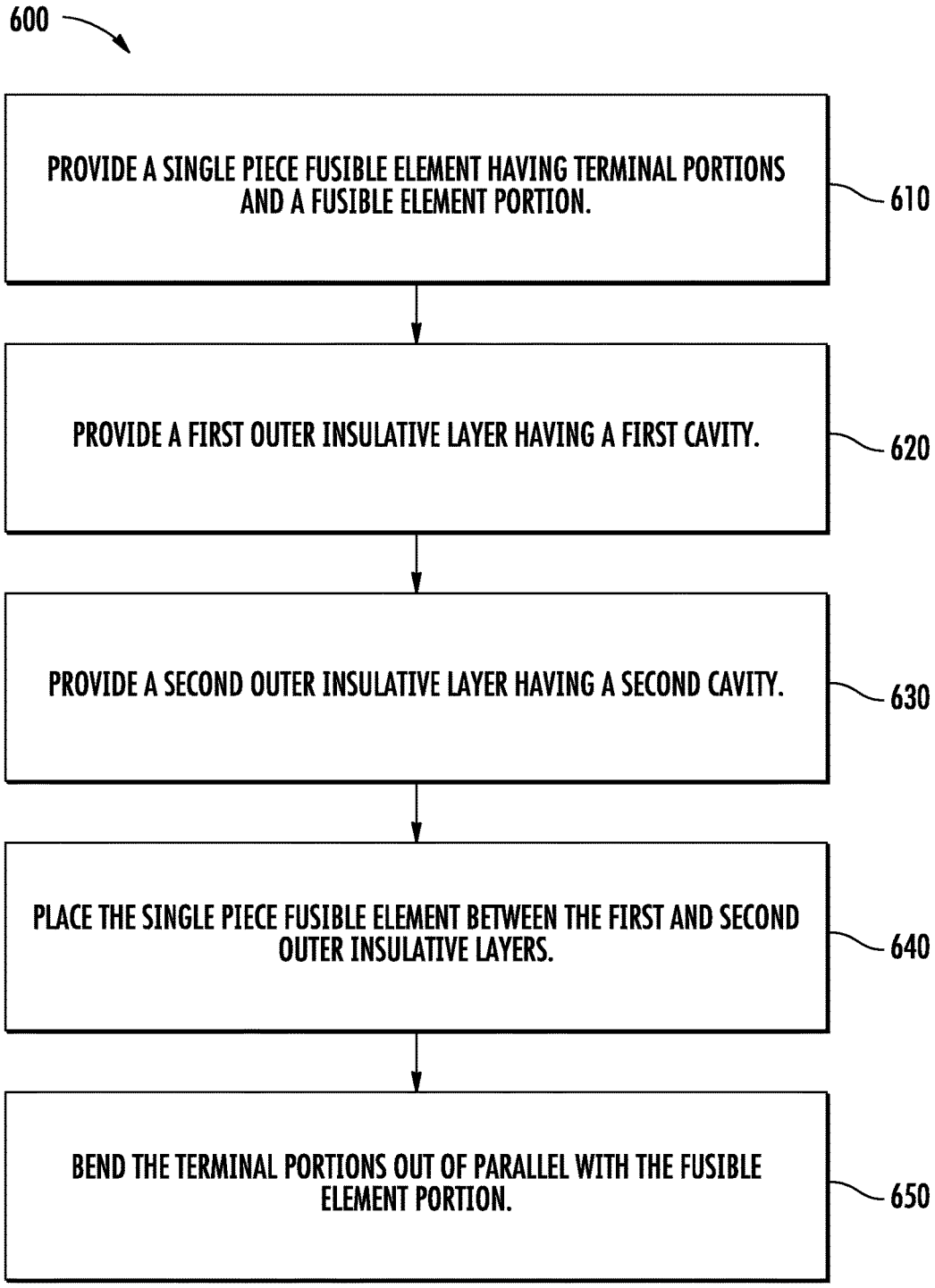
FIG. 6 illustrates a logic flow for a method of manufacturing a high breaking capacity fuse.

FIGS. 5A-5C depict the fuse 100 in various stages of manufacture, or assembly according to at least one example of the present disclosure. FIG. 6 is a logic flow for a method 600 of manufacturing a high breaking capacity fuse according to at least one example of the present disclosure. It is worthy to note, that the logic flow 600 is described with reference to the fuse 100 and FIGS. 5A-5C. However, this is for purposes of convenience and clarity and not intended to be limiting. In particular, the logic flow 600 could be implemented to manufacture and/or assemble a fuse having a different configuration and/or more or less components than depicted in FIGS. 5A-5C. Examples are not limited in this context.

The logic flow 600 may begin at block 610. At block 610 "provide a single piece fusible element having terminal portions and a fusible element portion," a single piece fusible element can be provided. For example, the single piece fusible element 130 having the terminal portions 132 and 134 as well as the fusible element portion 136 can be provided.

Continuing to block 620 "provide a first outer insulative layer having a first cavity," an outer insulative layer can be provided. For example, the top layer 110 having the cavity 112 can be provided. Continuing to block 630 "provide a second outer insulative layer having a second cavity," another outer insulative layer can be provided. For example, the bottom layer 120 having the cavity 122 can be provided.

Continuing to block 640 "place the single piece fusible element between the first and the second outer insulative layers," the single piece fusible element 130 can be placed between the top and bottom layers 110 and 120. Additionally, the cavities 112 and 122 can be aligned to define the chamber 140 where the fusible element portion 136 of the single piece fusible element 130 is arranged or disposed.

Continuing to block 650 "bend the terminal portions out of parallel with the fusible element portion," the first and second terminal portions 132 and 134 can be bent out of parallel with the fusible element portion 136. For example, as depicted in FIG. 5B, the first and second terminal portions 132 and 134 (as well as mid portions 135 and 137) can be bent to be substantially parallel with the external surfaces 172 and 174 of the bottom layer 120. At this block, the terminal portions 132 and 134 may be substantially perpendicular to the fusible element portion 136 (not shown in FIG. 5B).

Additionally, the first and second terminal portions 132 and 134 can be bent out of parallel with the mid portions 135 and 137 and back into parallel with the fusible element portion 136. For example, as depicted in FIG. 5C, the first and second terminal portions 132 and 134 can be bent to be substantially parallel with the external bottom surface of the bottom layer 120. At this block, the terminal portions 132 and 134 may be substantially parallel to the fusible element portion 136 (not shown in FIG. 5C) and substantially perpendicular to the mid portions 135 and 137.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

While the present invention has been disclosed with reference to certain embodiments, numerous modifications, alterations and changes to the described embodiments are possible without departing from the sphere and scope of the present invention, as defined in the appended claim(s). Accordingly, it is intended that the present invention not be limited to the described embodiments, but that it has the full scope defined by the language of the following claims, and equivalents thereof.

What is claimed:

1. A high breaking capacity fuse comprising:

a first outer insulative layer, the first outer insulative layer having a first cavity formed therein;

a second outer insulative layer disposed on the first outer insulative layer, the second outer insulative layer having a second cavity formed therein;

a cup-shaped first ceramic insert disposed within the first cavity;

a cup-shaped second ceramic insert disposed within the second cavity, wherein the first and second ceramic inserts fit together to define a chamber; and a single piece fusible element disposed between the first outer insulative layer and the second outer insulative layer, the single piece fusible element comprising a first terminal portion, a second terminal portion, a fusible element portion having a plurality of rolls along its longitudinal axis, a first mid portion connecting the fusible element portion to the first terminal portion, and a second mid portion connecting the fusible element to the second terminal portion, wherein the fusible element portion is disposed at least partially within the chamber, wherein the first terminal portion extends along at least one outer surface of the second outer insulative layer, and the second terminal portion extends along at least one outer surface of the second outer insulative layer;

wherein each of the first and second terminal portions has grooves formed in opposing sides thereof, and wherein the first outer insulative layer includes tongue portions formed in a top edge thereof, the tongue portions disposed within the grooves.

2. The high breaking capacity fuse of claim 1, wherein the single piece fusible element is formed from a single piece of conductive material and the fusible element portion comprises a plurality of cutouts disposed along the plurality of rolls.

3. The high breaking capacity fuse of claim 2, wherein the single piece fusible element comprises a first bend between the first terminal portion and the fusible element portion and a second bend between the second terminal portion and the fusible element portion.

4. The high breaking capacity fuse of claim 3, wherein the first terminal portion extends along at least a first and a second outer surface of the second outer insulative layer and the second terminal portion extends along at least the second and a third outer surface of the second outer insulative layer.

5. The high breaking capacity fuse of claim 4, wherein the plurality of bends of the single piece fusible element further comprises a third bend disposed in a distal end of the first terminal portion and a fourth bend disposed in a distal end of the second terminal portion.

6. The high breaking capacity fuse of claim 5, the first terminal portion comprising a first sub portion arranged between the first and third bend and a second sub portion arranged between the third bend and an end of the first terminal portion, wherein the first sub portion is substantially parallel to the first outer surface and the second sub portion is substantially parallel to the second outer surface.

7. The high breaking capacity fuse of claim 5, the second terminal portion comprising a first sub portion arranged between the first and third bend and a second sub portion arranged between the third bend and an end of the first terminal portion, wherein the first sub portion is substantially parallel to the third outer surface and the second sub portion is substantially parallel to the second outer surface.

8. The high breaking capacity fuse of claim 1, wherein the first outer insulative layer and the second outer insulative layer are joined via an ultrasonic welding process.

9. A method comprising:

providing a single piece fusible element, the single piece fusible element comprising a first terminal portion, a second terminal portion, a fusible element portion, a first mid portion connecting the fusible element portion to the first terminal portion, and a second mid portion connecting the fusible element portion to the second terminal portion;

providing a first outer insulative layer, the first outer insulative layer having a first cavity formed therein;

providing a second outer insulative layer, the second outer insulative layer having a second cavity formed therein;

providing a cup-shaped first ceramic insert disposed within the first cavity;

providing a cup-shaped second ceramic insert disposed within the second cavity, wherein the first and second ceramic inserts fit together to define a chamber;

placing the single piece fusible element between the first and the second outer insulative layers with the fusible element portion at least partially disposed within the chamber; and bending the first and second terminal portions out of parallel with the fusible element portion;

wherein each of the first and second terminal portions has grooves formed in opposing sides thereof, and wherein the first outer insulative layer includes tongue portions formed in a top edge thereof, the tongue portions disposed within the grooves.

10. The method of claim 9, wherein the first terminal portion extends along at least one outer surface of the second outer insulative layer and the second terminal portion extends along at least one outer surface of the second outer insulative layer.

11. The method of claim 10, comprising bending end portions of the first and second terminal portion out of parallel with mid portions of the first and second terminal portions.

12. The method of claim 11, wherein the first terminal portion extends along at least a first and a second outer surface of the second outer insulative layer and the second terminal portion extends along at least the second and a third outer surface of the second outer insulative layer.

13. The method of claim 12, wherein the single piece fusible element comprises a third bend disposed in a distal end of first terminal portion and a fourth bend disposed in a distal end of the second terminal portion.

14. The method of claim 9, comprising joining the first and second outer insulative layers via an ultrasonic welding process.

* * * * *